United States Patent [19]

Osborne

[11] Patent Number: 4,474,293

[45] Date of Patent: Oct. 2, 1984

[54] MULTI-PRODUCT MERCHANDISING PACKAGE

[75] Inventor: Edward L. Osborne, Kansas City, Kans.

[73] Assignee: Westvaco Corporation, New York, N.Y.

[21] Appl. No.: 493,208

[22] Filed: May 10, 1983

[51] Int. Cl.[3] ..... B65D 65/00; B65D 71/08

[52] U.S. Cl. ..... 206/497; 206/586; 206/587; 206/592

[58] Field of Search ..... 206/497, 591, 592, 593, 206/594, 586, 587

[56] References Cited

U.S. PATENT DOCUMENTS

| | | | |
|---|---|---|---|
| 1,849,065 | 3/1932 | Biederman | 206/591 |
| 2,689,079 | 9/1954 | Timer | 206/591 |
| 2,744,624 | 5/1956 | Hoogstoel et al. | 206/591 |
| 2,809,745 | 10/1957 | Bramming | 206/594 |
| 3,198,327 | 8/1965 | Boehling et al. . | |
| 3,385,429 | 5/1968 | Becker et al. . | |
| 3,416,288 | 12/1968 | Coons . | |
| 3,516,538 | 6/1970 | Van Antwerpen | 206/594 |
| 3,675,767 | 7/1972 | Taylor . | |
| 3,990,576 | 11/1976 | Heaney | 206/497 |
| 4,094,406 | 6/1978 | Zietzchmann | 206/497 |
| 4,333,570 | 6/1982 | Heider | 206/497 |

*Primary Examiner*—Joseph Man-Fu Moy

[57] ABSTRACT

A multi-product merchandising package comprises a base pad having a plurality of products situated thereon covered by a heat shrunk film overwrap. The base pad is prepared from a combination of at least one sheet of single wall corrugated paperboard bonded to at least one sheet of single face corrugated paperboard in such a manner that the corrugated surface of the single face sheet faces upwardly. The corrugated surface of the single face sheet is selectively embossed in a pattern that corresponds to the size and shape of the products situated thereon for positioning and retaining the products on the base pad. The heat shrunk film conforms to the shape of the products and base pad to form a compact unit package. Where desired, base pads may be positioned at both the top and bottom of the packaged products.

4 Claims, 8 Drawing Figures

MULTI-PRODUCT MERCHANDISING PACKAGE

Background of Invention

The present invention relates generally to a package for grouping and unitizing products of substantially the same size and shape for shipping and storage. More particularly, the invention has particular utility as a package for goods that may be sold and carried out in bulk without further packaging.

For instance, canned goods such as vegetables, soup, soft drinks, beer and motor oil are often sold in bulk, i.e., six or more cans. Conventional practice in the past has called for corrugated shippers or boxes as the means for distributing such goods. Such shippers generally completely enclose the product with the drawback that the product usually cannot be identified without opening the shipper or the shipper must be printed with an identifying legend and graphics. This is not always practical where a variety of products are packaged at one central plant or distribution center. Moreover, such shippers require a considerable amount of paperboard, they are expensive to manufacture and they present undesirable inventory problems.

More recently there have been some suggested alternatives to replace corrugated shipping containers for various packaging applications. One such alternative is to use a base pad having a plurality of openings die cut therein which individually or collectively receive and position products placed on the pad. These units are then bound together with a film overwrap that is heat shrunk to keep the products in place. U.S. Pat. Nos. 3,198,327 and 3,385,429 each show constructions as described. In other cases, the products are fastened to base pads with strips of adhesive as shown in U.S. Pat. No. 3,675,767, and in at least one case, the base pad is provided with abbreviated side walls which conform to the shape of the products during the heat shrinking process as shown in U.S. Pat. No. 3,416,288. Nevertheless, the packages disclosed in the aforementioned U.S. Patents, and other packages presently on the market as proposed alternatives to conventional paperboard containers, suffer from several drawbacks. First of all, the base pads generally used have little or no structural integrity and rely for their strength on the products packaged and the heat shrunk film. Secondly, with the exception of U.S. Pat. No. 3,416,288, each of the prior art constructions either do not provide a product positioning aid, or the aids severely reduce the overall strength of the base pads themselves since they are provided by cutting the base pad material.

Accordingly, one of the basic objectives of the present invention is to provide a competitive shipping and storage container or package for a plurality of products which is a valid substitute for conventional paperboard containers.

Another object of the present invention is to provide such a package which has good strength and structural integrity within the base pad member itself so that the package need not rely on the packaged products for its inherent strength.

Yet another object of the present invention is to provide an improved package having good material cost savings, weight savings, maintenance of the product, cleanliness, ready product identification and still other advantages that will become even more evident from the complete disclosure of the invention provided herewith.

Summary of Invention

The present invention relates to a multi-unit merchandising package and more particularly to a package for grouping and unitizing a plurality of products of substantially the same size and shape for shipping, storage and display. The package comprises at least one generally flat base pad member upon which the products are placed, and a heat shrinkable sleeve or overwrap which completely surrounds the base pad member and is preferably shrunk into snug engagement with the individual products. Where desired, base pads may be used at both the top and bottom of the products. The base pad member is preferably prepared from corrugated paperboard, and more specifically, from the laminated product of a sheet of single faced corrugated paperboard bonded to a sheet of single wall corrugated paperboard. The corrugations in the sheets are preferably arranged to lie at right angles to one another for increased bending strength in all directions. The lamination is prepared by bonding the flat face of the single faced sheet to one of the faces of the single wall sheet so that the corrugated layer of the single faced sheet faces upwardly. The corrugated layer of the single faced sheet is then selectively embossed in a pattern corresponding to the individual products of the group to be packaged, and the products are placed on the base pad member so that they fit within the embossed areas. Thus, as indicated, special benefit is obtained when the products to be packaged have a uniform end shape and preferably outwardly extending rims or chimes since these type ends readily fit into the embossed areas.

The choice of sleeve or overwrap material is not critical. However, it is preferred to employ biaxially oriented heat shrinkable thermoplastic films. Such films include the polyesters, polyamides, polyolefins, polyvinyls and the like. The film sleeve or overwrap should be properly sized and have sufficient shrink energy to form a snug fit around the products and base member when exposed to heat.

Detailed Description

Corrugated paperboard is made in several standard types, including single face, single wall and double wall material. The single face material consists of a flat face or liner glued to a corrugated layer. This material is easily bent or curved in the direction of the corrugations so that it may conform to products about which it is wrapped. Single wall corrugated paperboard consists of a corrugated sheet with liners glued on each side thereof. It is much stiffer in both directions, i.e., along the corrugations and perpendicular to the corrugations, than single face and generally tends to hold its shape very well. Meanwhile, double wall corrugated paperboard consists of three liners alternately arranged with two corrugated sheets, and is made by bonding the corrugated surface of a single face sheet to one of the liners of a single wall sheet. It is therefore, much stiffer and more rigid than single wall paperboard.

Figure 1:
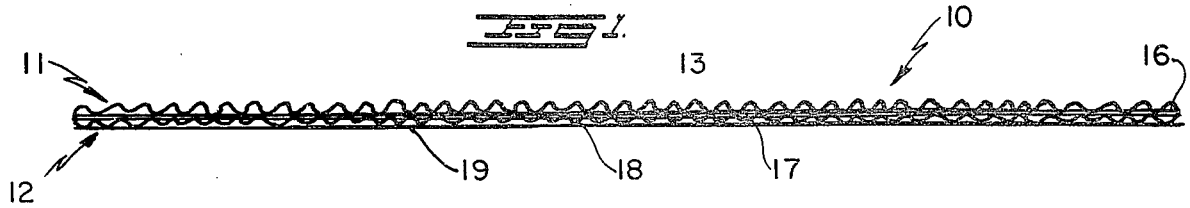
FIG. 1 is an end view of the base pad member according to the present invention.
Figure 2:
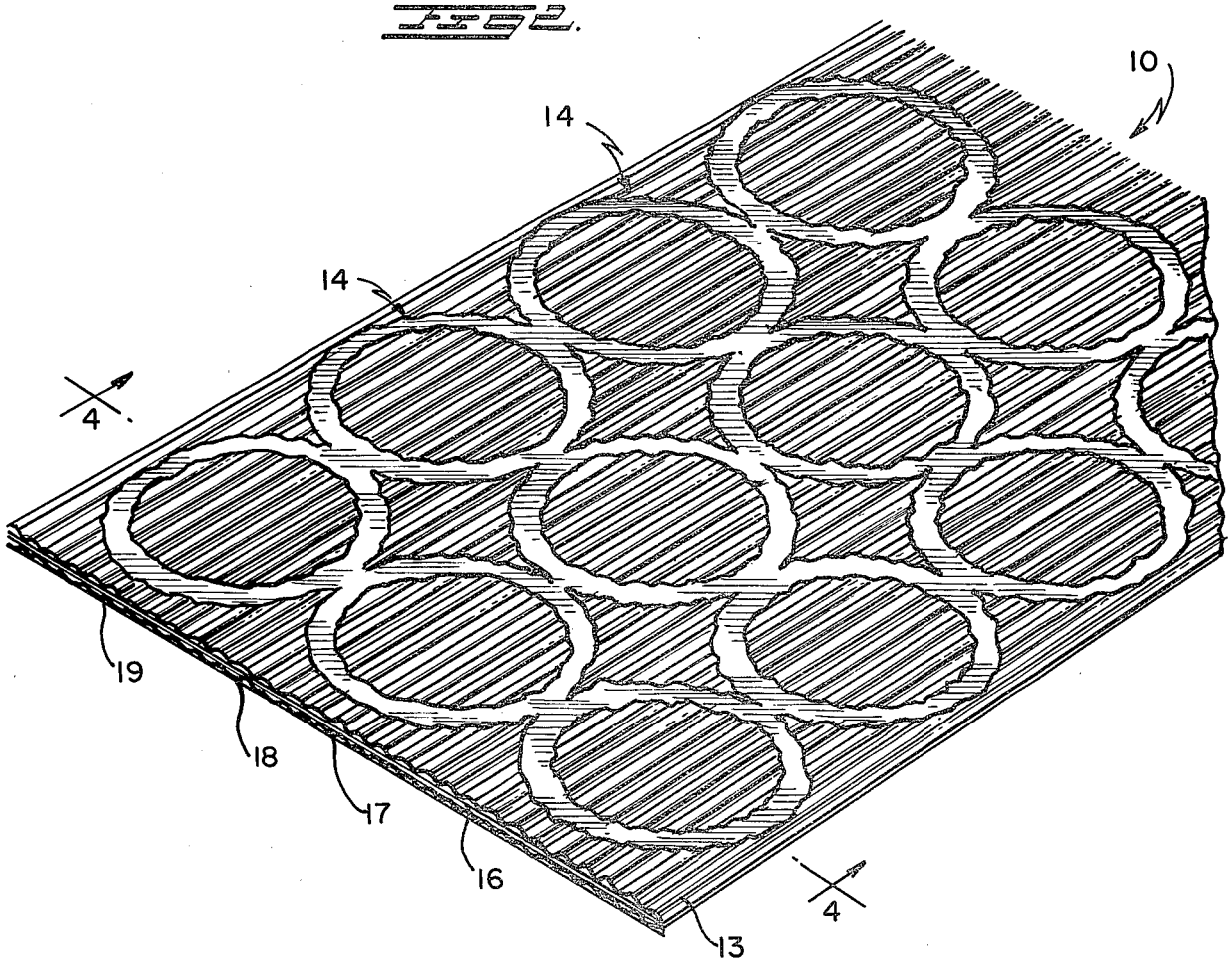
FIG. 2 is a perspective view of a base pad member made in accordance with the present invention showing embossed areas for positioning products thereon.

In the present invention, both a single face sheet and a single wall sheet are used to make the base pad member 10, except that, instead of bonding the corrugated surface of the single face sheet to one of the liners of the single wall sheet, as in the manufacture of double wall material, the liner surface of the single face sheet is bonded to one of the liners of the single face sheet. Thus, referring more particularly to FIG. 1, a preferred construction for the base pad member 10 is shown as comprising a lamination consisting of a sheet of single face material 11 bonded to a sheet of single wall material 12. The single faced sheet 11 is arranged with its corrugated surface 13 facing upwardly and its liner member 16 bonded to the liner member 17 of the single face sheet 12. The single face sheet 12 further comprises the corrugated member 18 and another liner member 19. This construction is arranged to provide a generally irregular but highly frictional surface for supporting products P placed thereon. In addition, as shown in FIG. 2, the upwardly facing corrugations 13 of single face sheet 11 are susceptible of being selectively collapsed or embossed to produce recessed areas 14 into which the ends of the products P may fit. The embossing or collapsing of the single face corrugations in a selective manner provides a means for both positioning and retaining the products in position on the base pad 10 without severe loss of strength to the base pad because the single face sheet components comprising liner members 17 and 19, and the corrugated medium 18 remain undisturbed.

Figure 3:
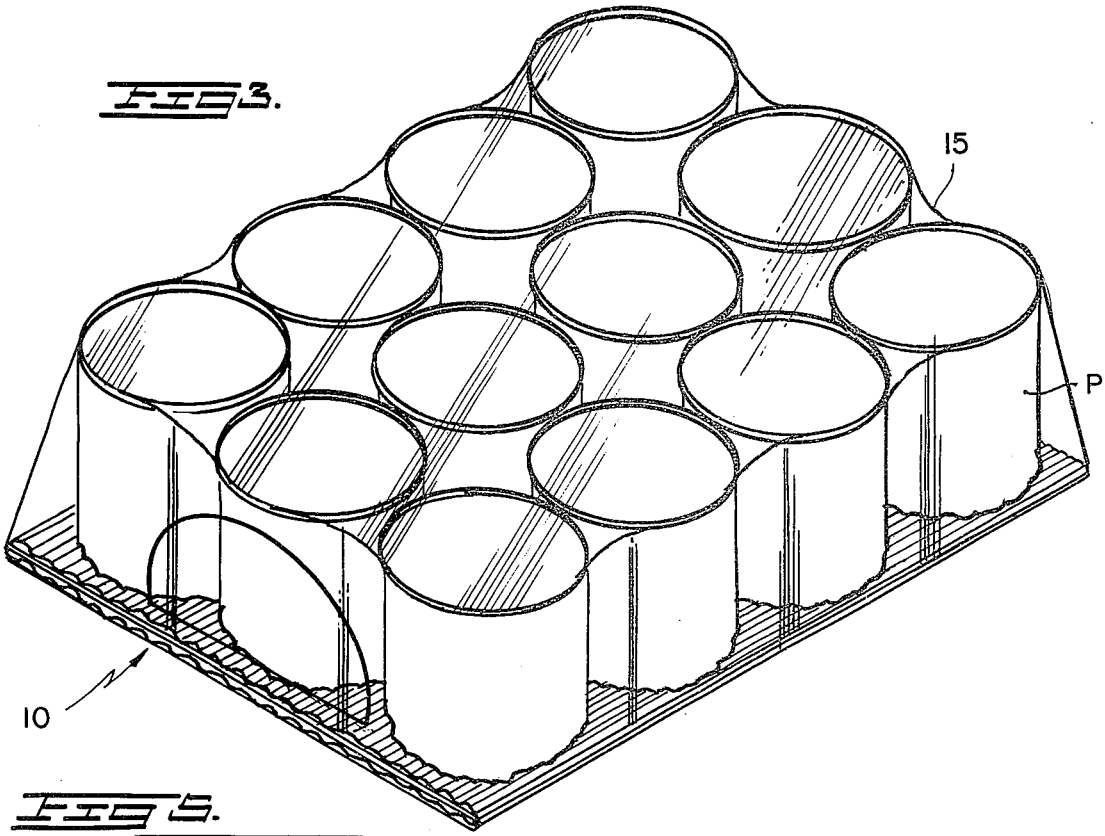
FIG. 3 is a perspective view of a base pad member having a plurality of products packaged according to the present invention.

After the products P are placed on the base pad, the entire package is enclosed in a sleeve or wrapper 15 which is heat shrunk as shown in FIG. 3 to form a compact unit which conforms to the shape of the products P and base pad 10. In this condition the package is ready for shipping, storage and display.

Figure 4:
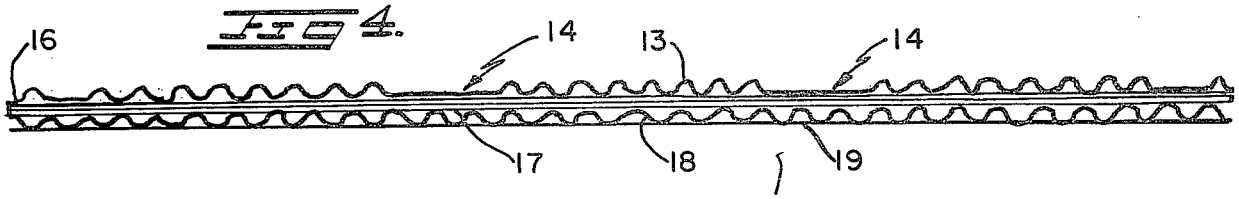
FIG. 4 is a cross-sectional view taken along the lines 4—4 of FIG. 1 showing the construction of the base member and the embossed areas.

FIG. 4 is a cross sectional view of the base pad 10 showing the embossed areas 14 for packaging cylindrical products P having chimed ends. Note that the embossing 14 only collapses the corrugations 13 in the single face sheet 11 and does not disturb the corrugations 18 in the single wall sheet 12.

Figure 5:
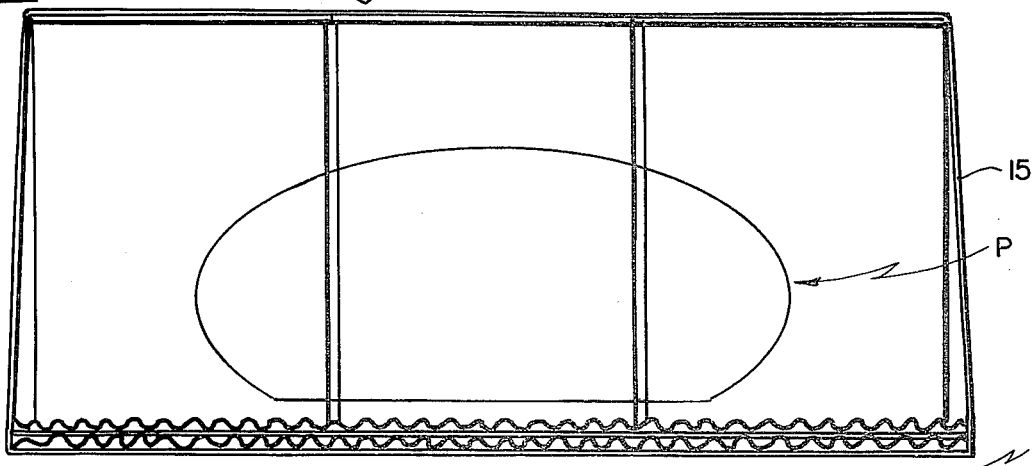
FIG. 5 is an end view of the package shown in FIG. 3.

The end view of the package shown in FIG. 5 illustrates how the ends of the products P may be gripped and held in place by the corrugations of the single wall sheet outside the embossed areas. Similarly, the illustration in FIG. 6 of a package having base pad members 10 both top and bottom shows how such products may be isolated and protected for increased stacking strength.

Figure 7:
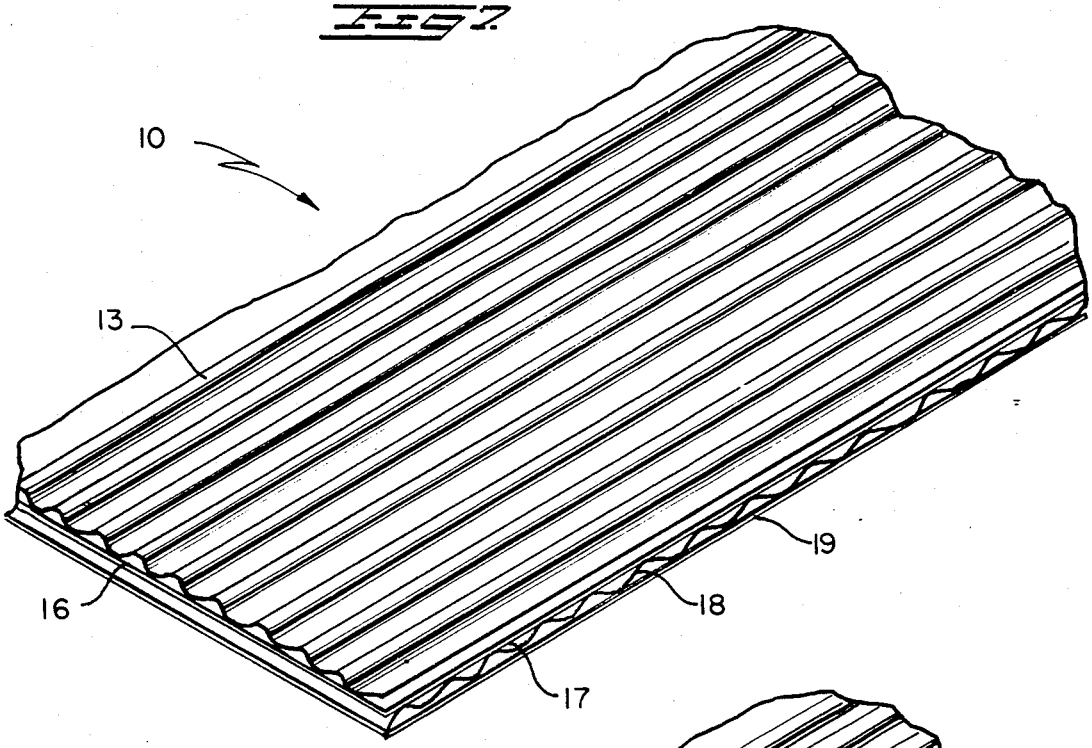
FIG. 7 is a partial perspective view of a base member according to the present invention which employs an alternative construction; and, FIG. 8 is a partial perspective view of a base member showing an alternative shape for the embossed areas for positioning products thereon.
Figure 8:
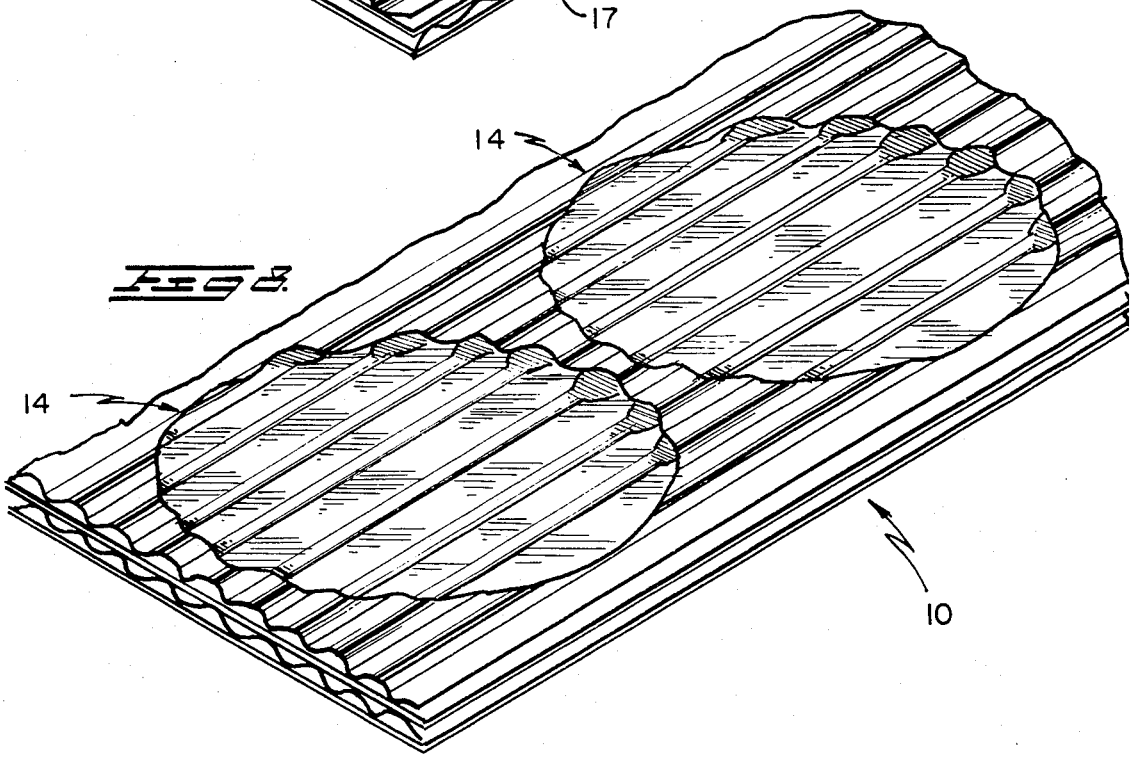

FIG. 7 is a perspective view of a base pad member 10 having the corrugations 13 in the single face sheet 11 oriented at right angles to the corrugations 18 in the single wall sheet 12. This arrangement yields a construction having better bending strength in all directions. It will be understood that for each embodiment, the overall strength of the base pad is enhanced by bonding the liner member 16 of the single face sheet 11 to one of the liner members 17 or 19 of the single wall sheet 12 notwithstanding the direction of corrugations.

Figure 6:
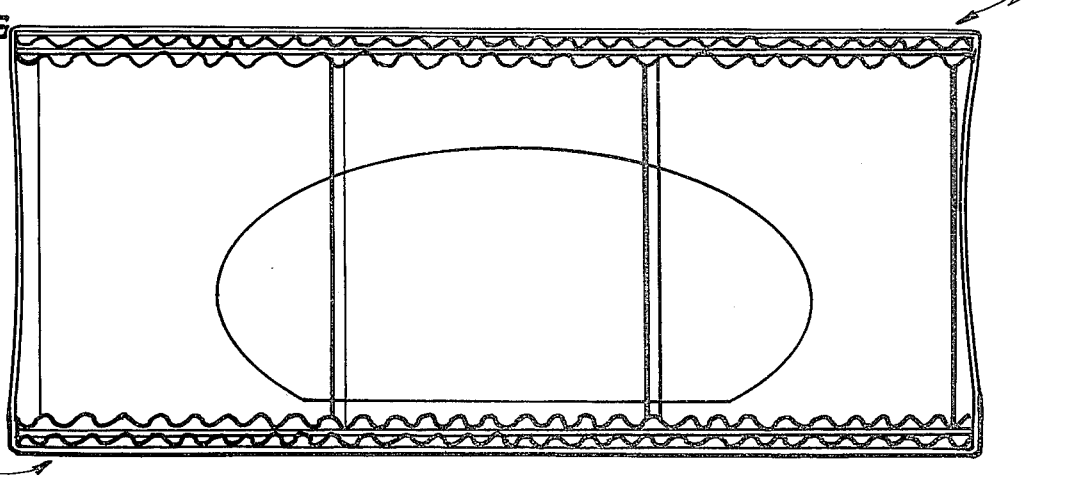
FIG. 6 is an end view of a package having base pad members at both the top and bottom of the package.

FIG. 6 illustrates another embodiment of the invention wherein the debossed areas 14 are sized to fit the flat end of products to be packaged. No special benefit is obtained by packaging products of any particular shape except that the heat shrink film may conform to round or cylindrical products more readily than to products of rectangular or other polygonal shapes. There is an additional strength advantage obtained when all products are of about the same size.

I claim:

1. A multi-product merchandising package comprising:

(a) a plurality of closely grouped products arranged in side-by-side relation;

(b) a substantially rigid and planar base pad member onto which said products are situated, said base pad member comprising in combination the laminated product of at lease one sheet of single wall corrugated paperboard material bonded to at lease one sheet of single face corrugated paperboard material wherein the flat face of the single face sheet is bonded to one of the faces of the single wall sheet so that the corrugations of said single face sheet face upwardly wherein they are contacted by the ends of the products situated thereon, said upwardly facing corrugations being selectively collapsed in the areas in contact with said products for positioning and retaining the products in place on said base pad, said corrugated sheets being oriented so that the direction of corrugations in said single wall sheet is arranged to be perpendicular to the direction of corrugations in said single face sheet;

and, (c) a plastic film overwrap heat shrunk around and securely engaging said base pad member and products to form a unitary package.

2. The package of claim 1 wherein a second substantially rigid and planar base pad member as described in paragraph (b) is positioned opposite said first base pad member so that the corrugated surface thereof comes in contact with the other ends of said products.

3. The package of claim 2 wherein said embossed areas correspond generally to the outer peripheral shape of the ends of said products.

4. The package of claim 2 wherein said embossed areas correspond generally to the total area and shape of the ends of said products.

* * * * *